US008167156B2

(12) United States Patent
Milante

(10) Patent No.: US 8,167,156 B2
(45) Date of Patent: May 1, 2012

(54) CONVERTIBLE CHILD-RESISTANT VIAL

(75) Inventor: Gaétan Milante, Carignan (CA)

(73) Assignee: Ecolopharm Inc., Chambly, Quebec (CA)

( * ) Notice: Subject to any disclaimer, the term of this patent is extended or adjusted under 35 U.S.C. 154(b) by 888 days.

(21) Appl. No.: 12/078,573

(22) Filed: Apr. 1, 2008

(65) Prior Publication Data

US 2009/0095699 A1 Apr. 16, 2009

(51) Int. Cl.

| | |
|---|---|
| ***B65D 55/02*** | (2006.01) |
| ***B65D 3/02*** | (2006.01) |
| ***B65D 41/02*** | (2006.01) |
| ***B65D 45/16*** | (2006.01) |
| ***B65D 47/08*** | (2006.01) |

(52) U.S. Cl. ..... 215/217; 215/237; 215/253; 215/317; 215/382; 215/209; 220/839; 222/556; 222/153.05; 222/153.06; 222/153.14

(58) Field of Classification Search ..... 215/217, 215/253, 237, 216, 219, 221, 317, 209, 235, 215/318; 220/839, 265; 222/556, 153.14, 222/153.05, 153.06, 541.6, 541.5
See application file for complete search history.

(56) References Cited

U.S. PATENT DOCUMENTS

| | | | | |
|---|---|---|---|---|
| 3,765,578 | A | | 10/1973 | Stull |
| 3,860,135 | A | | 1/1975 | Yung et al. |
| 3,865,267 | A | | 2/1975 | Morris |
| 4,002,275 | A | | 1/1977 | Crowle et al. |
| RE29,779 | E | | 9/1978 | Morris |
| 4,119,232 | A | | 10/1978 | Thornton |
| 4,146,146 | A | | 3/1979 | Mar |
| 4,346,809 | A | | 8/1982 | Kusz |
| 4,397,397 | A | | 8/1983 | Herr |
| 4,406,376 | A | | 9/1983 | Berghahn |
| 4,433,789 | A | | 2/1984 | Gibilisco |
| 4,535,903 | A | | 8/1985 | Franchi |
| 4,854,459 | A | | 8/1989 | DeJonge |
| 4,974,735 | A | * | 12/1990 | Newell et al. ..... 215/253 |
| 4,991,729 | A | | 2/1991 | Hunter |

(Continued)

FOREIGN PATENT DOCUMENTS

| | | |
|---|---|---|
| CA | 952476 | 8/1974 |

(Continued)

OTHER PUBLICATIONS

European Search Report dated Mar. 2, 2009, issued in corresponding European Patent Application No. 08158257.9.

*Primary Examiner* — Robin Hylton
(74) *Attorney, Agent, or Firm* — Venable LLP; Robert Kinberg; Steven J. Schwarz

(57) ABSTRACT

The convertible child-resistant vial includes a container having an aperture and a peripheral wall and being provided with a first connection element in the form of contiguous locking and freeing housings provided in a collar extending from the peripheral wall; and a cap hingedly mounted to the container integrally thereof and including a second connection element for cooperating with the first connection element to close the vial in a child safe-manner. The second connection element is in the form of a tooth which is easily removable to convert the child-resistant vial into a non-child-resistant vial. The vial can be molded in a one piece body. The integral mounting of the cap to the container allows easing the distribution and handling of the vial.

12 Claims, 11 Drawing Sheets

U.S. PATENT DOCUMENTS

| | | | | |
|---|---|---|---|---|
| 5,031,784 | A | 7/1991 | Wright | |
| 5,137,260 | A | 8/1992 | Pehr | |
| 5,141,129 | A | 8/1992 | Jennings | |
| 5,270,011 | A * | 12/1993 | Altherr | 422/102 |
| 5,509,550 | A | 4/1996 | DeJonge | |
| 5,579,934 | A | 12/1996 | Buono | |
| 5,636,756 | A | 6/1997 | Johnson et al. | |
| 5,718,347 | A | 2/1998 | Walker | |
| 5,769,252 | A | 6/1998 | Volpe | |
| 5,819,967 | A | 10/1998 | Lo | |
| 5,826,738 | A | 10/1998 | Minh | |
| 6,161,711 | A | 12/2000 | Miceli et al. | |
| 6,772,902 | B1 | 8/2004 | White | |
| 7,070,063 | B2 | 7/2006 | Miceli et al. | |
| 7,124,904 | B1 | 10/2006 | Miceli et al. | |
| 2005/0103741 | A1 | 5/2005 | Shingle | |
| 2005/0242105 | A1 * | 11/2005 | Homann | 220/840 |

FOREIGN PATENT DOCUMENTS

| | | | |
|---|---|---|---|
| CA | 1177016 | | 10/1984 |
| WO | WO-02/16218 | A1 | 2/2002 |
| WO | WO-2005/026013 | A2 | 3/2005 |
| WO | WO-2006/102601 | A1 | 9/2006 |
| WO | WO-2007/103514 | A2 | 9/2007 |
| WO | WO 2007/108844 | A2 | 9/2007 |
| WO | WO-2007/109166 | A2 | 9/2007 |

* cited by examiner

CONVERTIBLE CHILD-RESISTANT VIAL

FIELD

The present invention generally relates to child-resistant safety vials. More specifically, the present invention relates to a child-resistant vial which may be converted to a non-child-resistant vial by the individual dispensing the vial to the user. The use of such child-resistant vials is common to contain and distribute medications.

BACKGROUND

Many types of vials exist to provide prescription medication to users. The simplest model consists in a container and an independent cap so mounted to the container that it can be removed simply by pulling on the cap.

Child-resistant vials have been known for some times. They come in many flavours. According to one type of child-resistant containers, the interior of the cap is provided with a liner that exerts a pressure onto the container for preventing the vial from being open easily, for example by children. A drawback of this first type of vials is that they require a first mold for the container and a second mold for the cap. Their assembly is also a two-step process including the assembly of the liner in the cap and then the assembly of the cap onto the vial.

Another well-known type of child-resistant vials is the arrow-type vial. This vial includes a container including a groove and a cap provided with a tooth; the cap being removable only when the tooth and groove are aligned. Arrows are provided on both the cap and the container to guide a user in aligning the tooth and groove. This type of vials still requires a two-step molding process.

Among the child-resistant vials, some have been proposed to convert the vial from a child-resistant configuration to a non-child-resistant configuration, for example by designing the neck of the container so that it can receive both arrow-type caps and caps that are not provided with a locking tooth.

Other convertible child-resistant vials are known which are more complicated and include a cap detached from the container and therefore requiring a two-part molding process.

DETAILED DESCRIPTION

Figure 1:
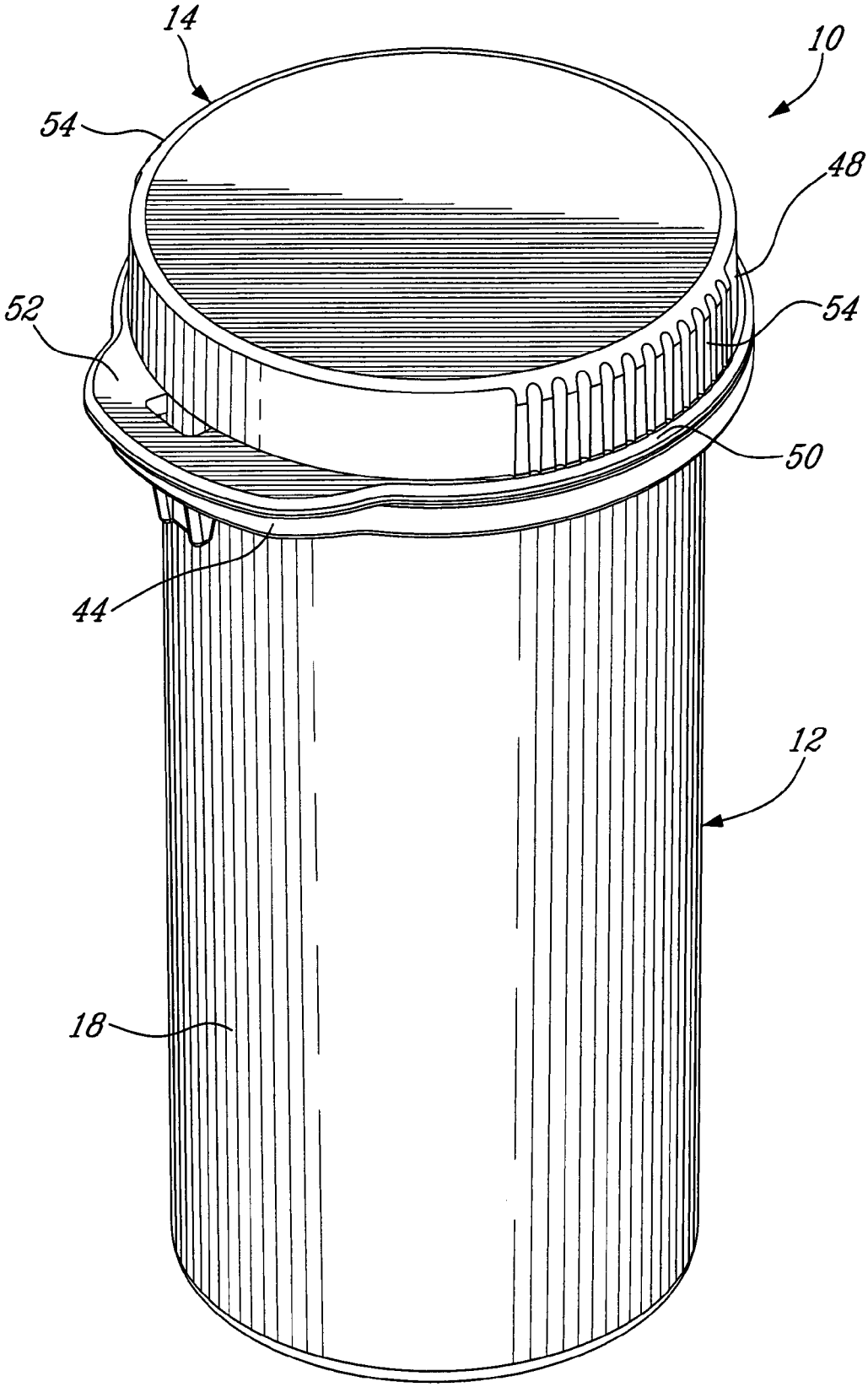
FIG. 1 is a top perspective view of a child-resistant vial according to a first illustrative embodiment of the present invention; the vial being illustrated closed and in a child-resistant configuration.
Figure 2:
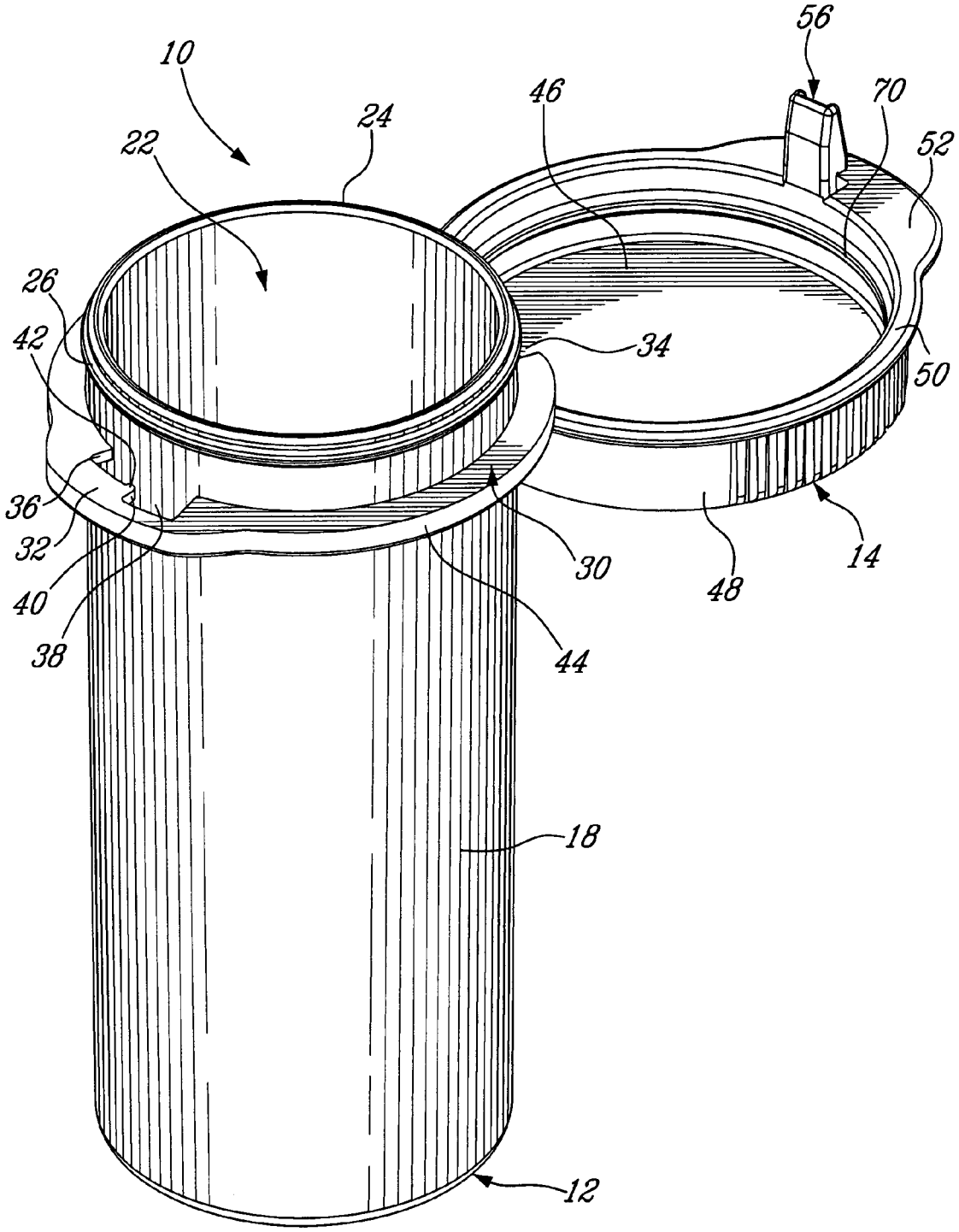
FIG. 2 is a top perspective view of the child-resistant vial from FIG. 1; the vial being illustrated opened.
Figure 3:
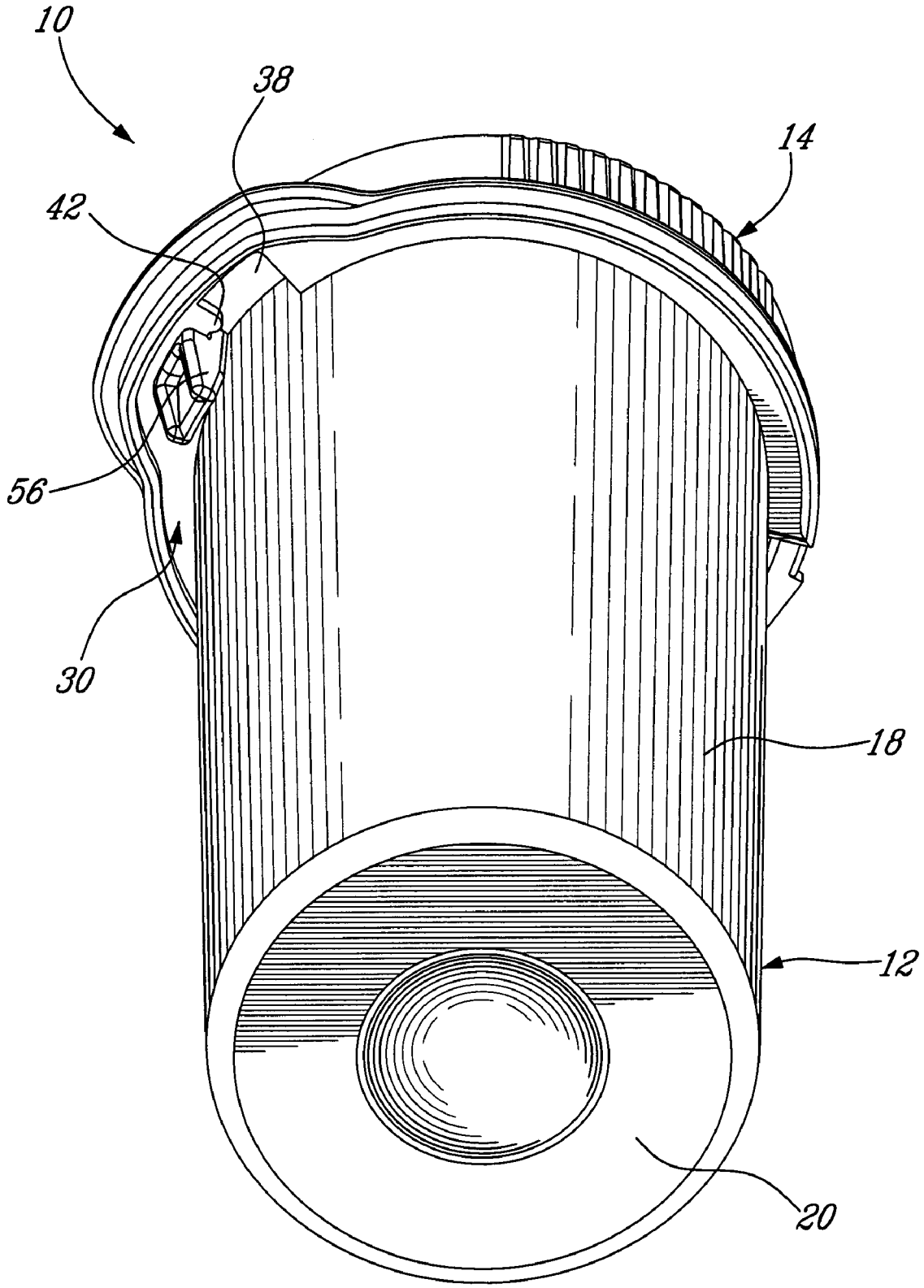
FIG. 3 is a bottom perspective view of the child-resistant vial from FIG. 1.

More specifically, in accordance with the present invention, there is provided a convertible child-resistant vial comprising:

a container having and aperture and a peripheral wall and being provided with a first connection element; and a cap hingedly mounted to the container integrally thereof for closing the aperture and including a second connection element for cooperating with the first connection element of the container to close the vial in a child-resistant manner; the second connection element being removable to convert the child-resistant vial into a non-child-resistant vial It is believed that the meaning of the expression "child-resistant" is well-known in the art. It should therefore not be limited herein in any ways. The expression child-resistant should be construed herein to include something or an operation that cannot be executed by a normal child or by any person having limited abilities with his/her hands, such as arthritics. This includes, without limitations, operations which can only successively be performed by combining at least two actions.

The vial from the present invention is one piece and can be obtained through a conventional on-step molding process for example.

Contrarily to vials from the prior art, the vial according to the present invention includes a cap that is integrally mounted to the container, which eases the distribution and handling of the vial as a single piece.

The present vial is easily convertible from a child-resistant to a non-child-resistant configuration by removing the second connection element using, for example, a cutting tool or simply by jiggling it.

Other objects, advantages and features of the present invention will become more apparent upon reading the following non restrictive description of illustrated embodiments thereof, given by way of example only with reference to the accompanying drawings.

In the following description, similar features in the drawings have been given similar reference numerals, and in order not to weigh down the figures, some elements are not referred to in some figures if they were already identified in a precedent figure.

A convertible child-resistant vial 10 according to a first illustrated embodiment of the present invention will now be described with reference to FIGS. 1 to 4.

The vial 10 comprises a container 12 and an integral cap 14, hingedly mounted to the container 12 via an integral hinge 16. The container 12, cap 14 and hinge 16 define a one piece body which is obtained through conventional molding process using a polymeric material such as copolymeric polypropylene. Other material, which can further be bio-degradable, can also be used, for example.

The container 12 is in the form of a hollow cylindrical body, having a peripheral wall 18 and a bottom 20 and defining a cavity 22. The peripheral wall 18 has an upper edge 24 which is provided with a peripheral lip 26. The lip 26 includes an undercut 28 registered with the hinge 16 (see FIG. 5), broader therefore, to ease pivoting the cap 14 as will be described furtherin.

The container 12 further includes a collar 30 located below the peripheral lip 26. The collar 30 includes an enlarged portion, which defines a tab 32, and an undercut 34 located diametrically opposite the tab 32. The collar undercut 34 is registered with the lip undercut 28 and is similarly dimensioned. The collar undercut 34 is provided for similar reason than the lip undercut 28.

The tab portion 32 of the collar 30 includes first and second contiguous notches 36 and 38 which respectively define first and second housings with the peripheral wall 18 for respectively locking and freeing a locking element 56 of the cap 14.

The second notch 38 extends radially from the container wall 18 beyond the first notch 36. The side wall 40 of the second notch 38, which is adjacent the first notch 36, includes a small lip 42, the purpose of which will be described furtherin. The collar 30 is further provided with a flange 44.

The first and second contiguous notches 36 and 38 together define a first connection element.

The cap 14 includes a top portion 46, dimensioned to conform to the circular contour of the wall 18, and a peripheral skirt 48 extending from the disk portion 46. The distal end of the skirt 48 is provided with a peripheral flange 50 having an enlarged portion defining a tab 52. The length of the skirt 48 with the flange 50 is such that the flange 50 contacts the flange 44 of the container 12.

The skirt 48 is provided with two diametrically opposite corrugated portions 54 to increase the grip on the cap 14 during manipulation as will be described furthering in more detail.

The tab 52 is positioned diametrically opposite the hinge 16.

The cap 14 further includes a locking tooth 56 extending from the skirt 48 and registered with the first notch 36 of the container tab 32. The locking tooth 56 includes a generally arrow-shaped body 58 connected to the skirt 48 via a stem portion 60. The arrow-shaped body 58 includes a first longitudinal side 62, which is flush with the inner surface of the skirt 48, and an opposite slanted side 64, which extends from the distal end 66 of the tooth 56 to a shoulder portion 68 defined by the body 58 and the stem portion 60 at the intersection thereof. The body 58 is dimensioned for easy insertion of the tooth 56 in the locking housing 36 when the cap 14 is positioned on the container 12. However, the removal of the cap 14 by pulling thereonto is prevented by the abutment of the shoulder 68 of the tooth 56 onto the tab 32. The closure of the vial 10 is thereby child-resistant.

As will now become more apparent, the tooth 56 define a second connection element that cooperates with the first connection element defined by the two notches 36-38 to close the vial 10 in a child-resistant manner as will be described furtherin.

The inner surface of the skirt 54 of the cap 14 includes a peripheral ring 70 to put pressure on the lip 26 of the edge of the container 12 so that the cap 14 is further secured to the container 12 in a snap-fit manner when it is positioned thereon.

Figure 4:
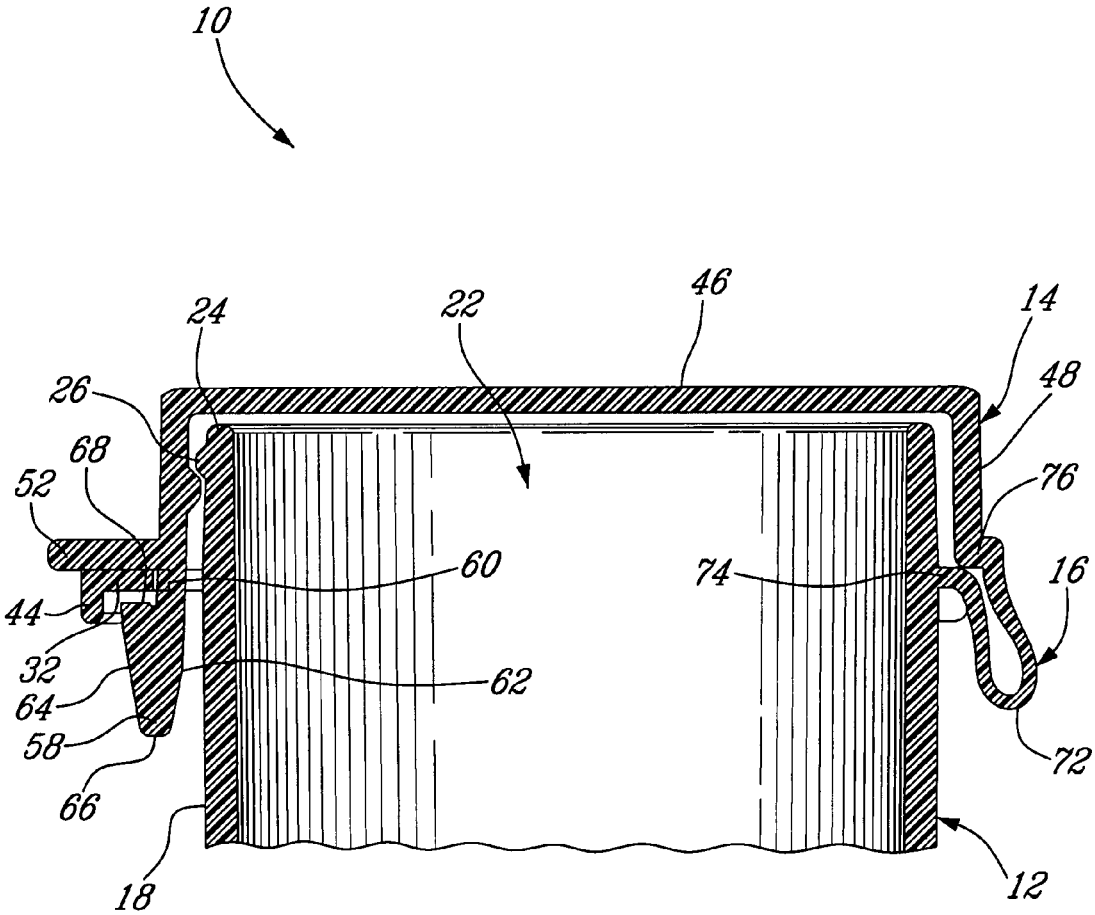
FIG. 4 is a partial cross section of the child-resistant vial from FIG. 1, illustrating the mounting of the cap on the container in a child-resistant configuration.

With reference to FIG. 4, the integral hinge 16 is in the form of a generally planar element having one fold 72, a first end 74 connected to the container wall 18 and a second end 76 connected to the cap 14 and more specifically to its skirt 48. The hinge 16 may alternatively have other configuration and sizes.

The operation of the cap 14 in relation to the container 12 for opening the vial 10 when it is closed in the child-resistant configuration will now be described with reference to FIGS. 5 to 7. As will become more apparent upon reading the following description, the opening of the vial 10, while in its child-resistant configuration, is achieved by the combined action of rotating and pulling the cap 14.

Figure 5:
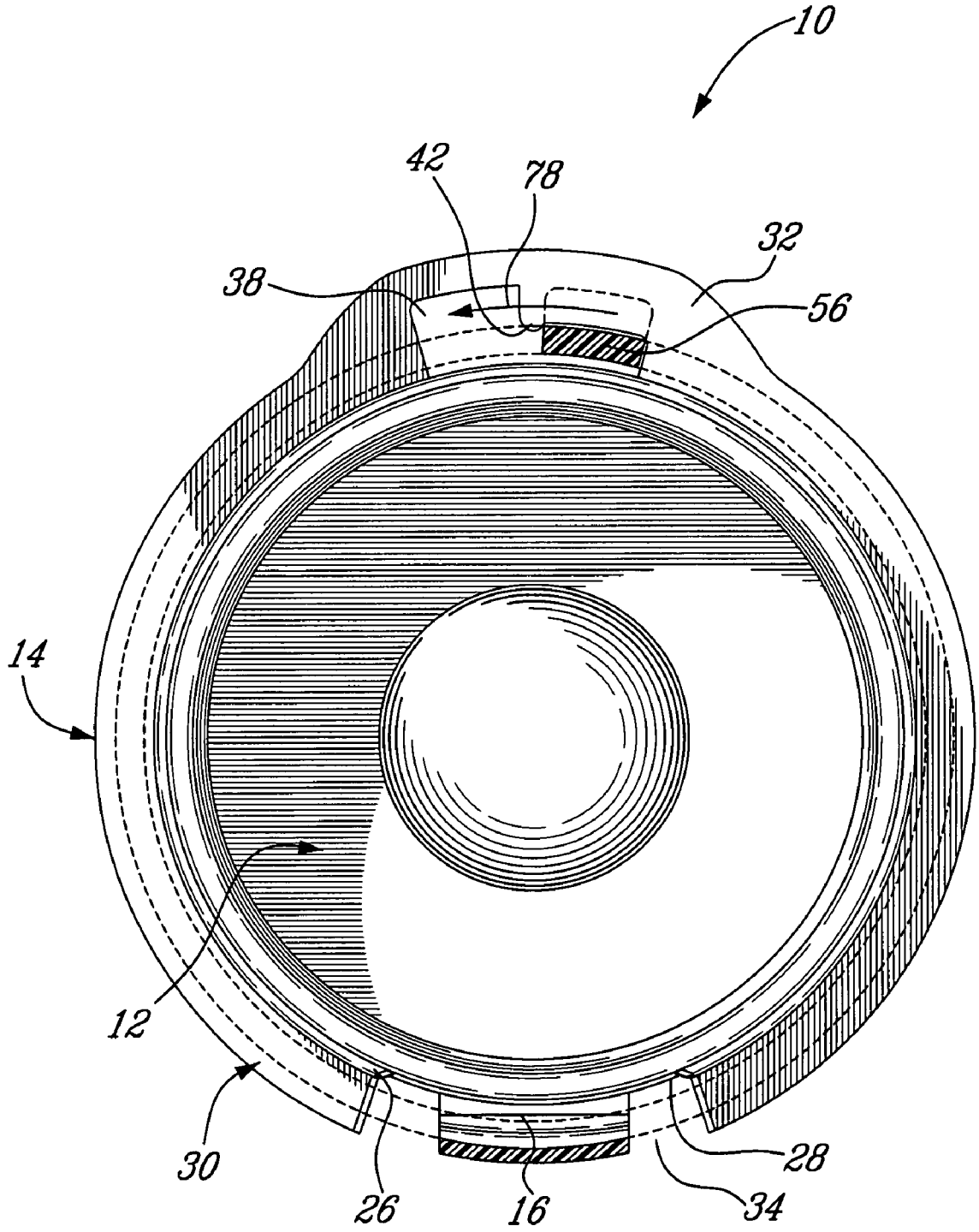
FIGS. 5 to 7 are bottom plan views of the child-resistant vial from FIG. 1, illustrating the removal of the cap in the child-resistant configuration.
Figure 6:
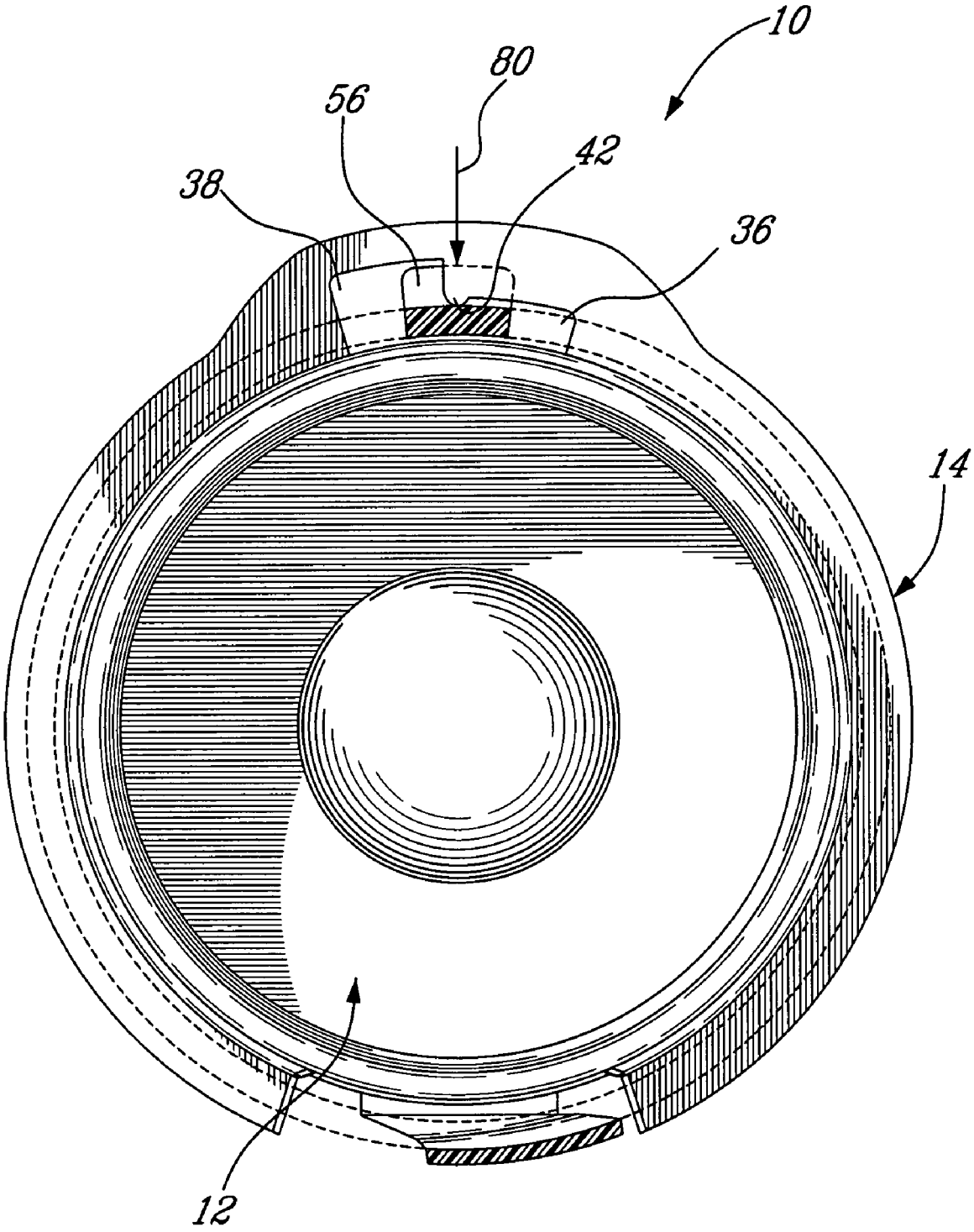

As illustrated in FIG. 5, the integral cap 14 is rotated in a direction that moves the tooth 56 from the locking housing 36 to the freeing housing 38 (see arrow 78). A force sufficient force to overcome the resistance caused by the small lip 42 on the stem portion 60 of the tooth 56 must be provided during rotation of the cap 14.

Figure 7:
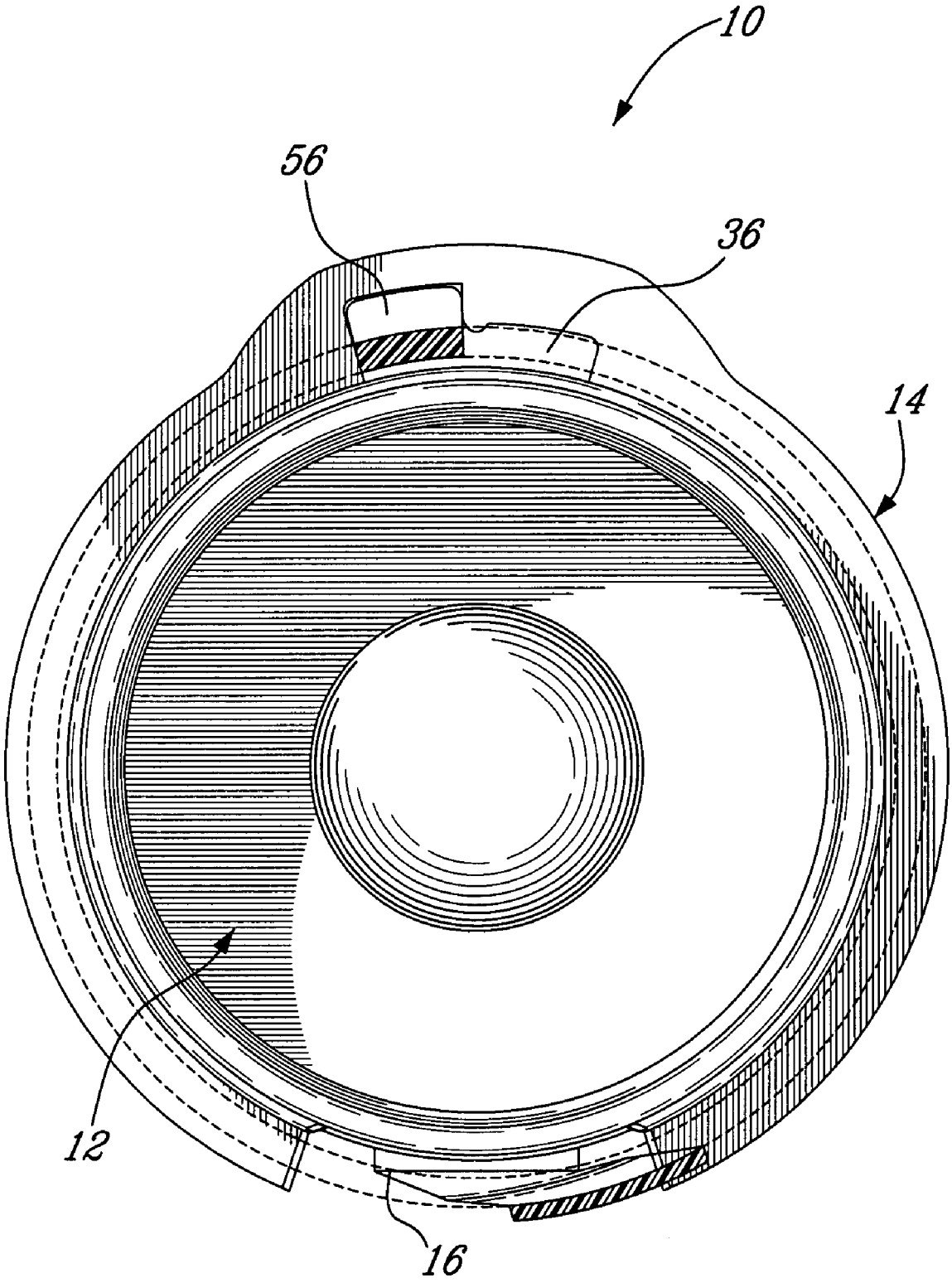

While the edge of the tooth 56 is moved beyond the lip 42, the user can begin exerting a pulling force on the cap 14, using for example the tab 32 (see arrow 80 on FIG. 6), so as to be able to lift the cap 14 when the tooth 56 is completely housed in the second notch 38 as illustrated in FIG. 7.

It is to be noted that since the integral hinge 16 is temporarily deformed by the rotation of the cap 14 during the opening of the vial 10, the cap 14 is biased in a neutral position, corresponding to the tooth 56 being aligned with the locking housing 36, when no rotational force is exerted onto the cap 14. This biasing force towards the neutral position is caused by the molecular memory of the polymer. It first results from this biasing force that a pivoting force sufficient to overcome both the resistance of the lip 42 on the tooth 56 and the biasing force is required in order to achieve the opening of the vial 10. A further consequence of the biasing force caused by the hinge 16 is that once the cap 14 is opened and released by the user, the cap 14 returns to its neutral position causing the tooth 56 to align with the locking housing 36. The vial 10 can then be closed by pivoting the cap 14 about the hinge 16 until the tooth 56 is positioned below the tab 32.

Figure 8:
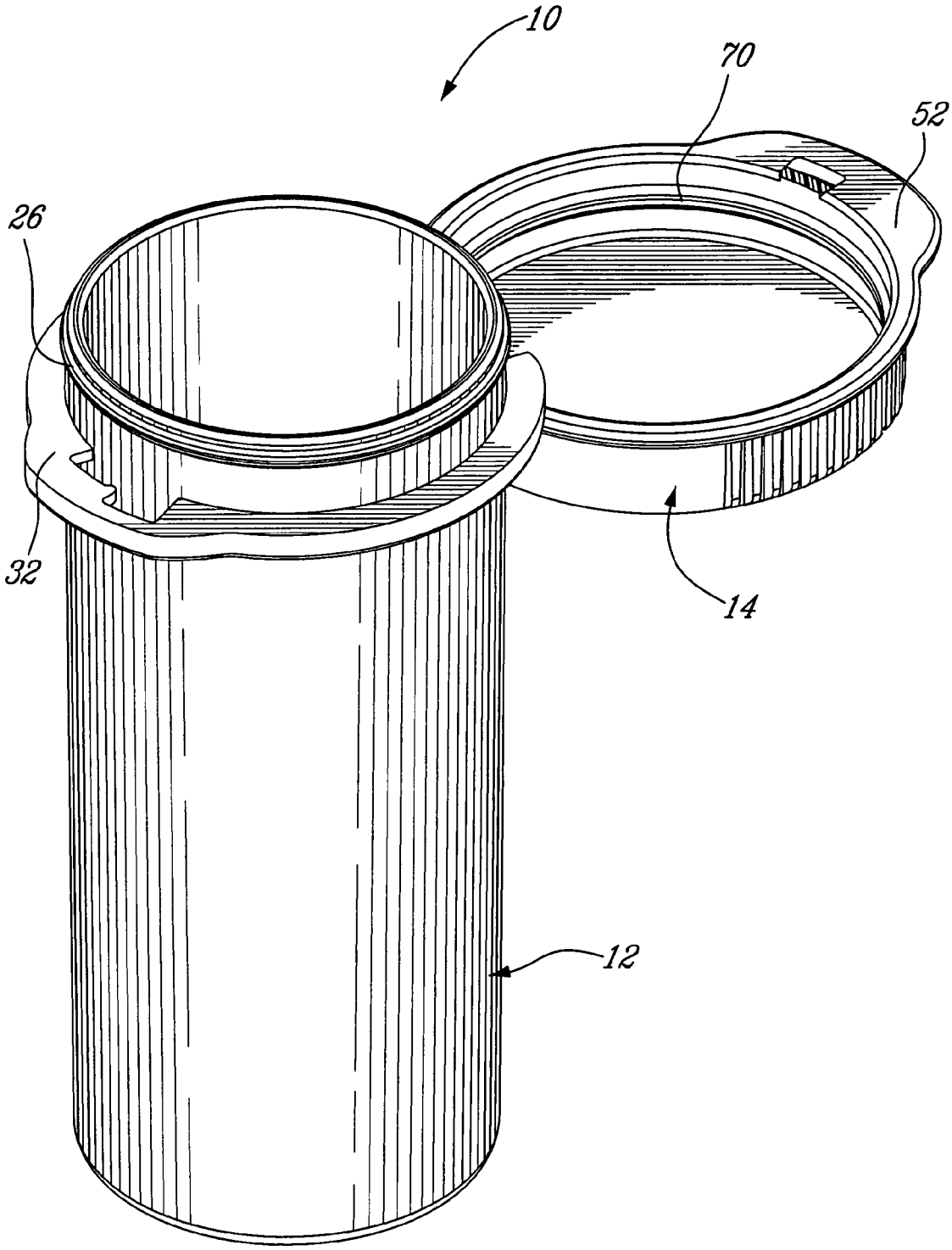
FIG. 8 is a top perspective view of the child-resistant vial from FIG. 1, showing the locking teeth of the cap removed so as to illustrate the non-child-resistant configuration.
Figure 9:
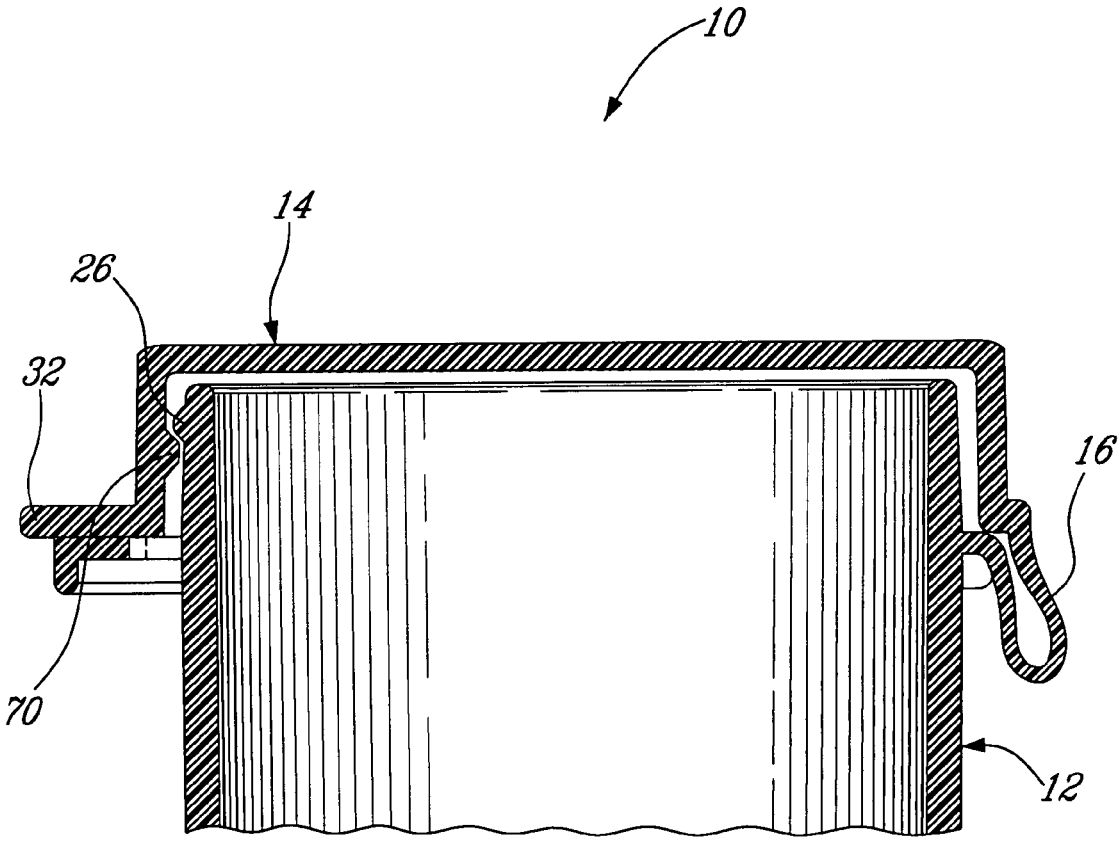
FIG. 9 is a partial cross section similar to FIG. 4, illustrating the mounting of the cap on the container in a non-child-resistant configuration.

The vial 10 can be permanently converted from a child-resistant configuration to non-child-resistant configuration by removing the tooth 56 (see FIGS. 8 and 9). This can be achieved by breaking the stem portion 62 of the tooth 56 using for example a cutting tool such as scissors (not shown) or simply by jiggling repeatedly the tooth 56 until it fells. This operation can be done for example by a professional such as a pharmacist before filling the vial 10 with drugs.

The vial 10 is therefore adaptable for a specific user's need. For example, some users, such as elders, people with limited manual dexterity, or simply others which do not have the need for the child-resistant feature, may remove the tooth 56. It is reminded that the cap 14 is still attached to the container when the vial 10 is in the non-child-resistant configuration.

To open the vial 10 when it is in the non-child-resistant configuration, a user simply pulls onto the cap 14, using for example the tab 52, to cause its pivoting about the hinge 16. No rotation is further required since the tooth 56 is no longer present to abut the tab 32. The only force required to open the vial 10 when it is in its non-child-resistant configuration is a relatively small pulling force to pass the ring 70 beyond the peripheral lip 26.

According to a further illustrative embodiment of a vial from the present invention (not shown), the lip 26 is provided only on a small portion of the edge 24 with the skirt 48 of the cap 14 being provided with registered elements to prevent the cap from inadvertently opening.

It is to be noted that many modifications could be made to the vial 10 described hereinabove, for example:

- The freeing housing 38 can be positioned to the right or left of the locking housing 36 thereby requiring to pivot the cap 14 respectively clockwise or counterclockwise for opening the vial 10;
- Other means than the cooperation of the lip 26 and the ring 70 can be used to prevent inadvertent opening of the vial 10 in its non-child-resistant configuration. Such means can include without limitations cooperating ring and groove, short threads, or any snap-fitted means. Threads provided onto both the edge of the container 12 and the cap 14 are to be dimensioned so that the cap 14 is removable by its pivoting within the resilience of the hinge 16;

The tabs 32 and 52 can be positioned at a different location relatively to the hinge 16 than diametrically opposite thereof. The tabs 32 and/or 52 can also be omitted; and The tooth 56 and housings 36-38 can alternatively be positioned in the container 12.

Figure 10:
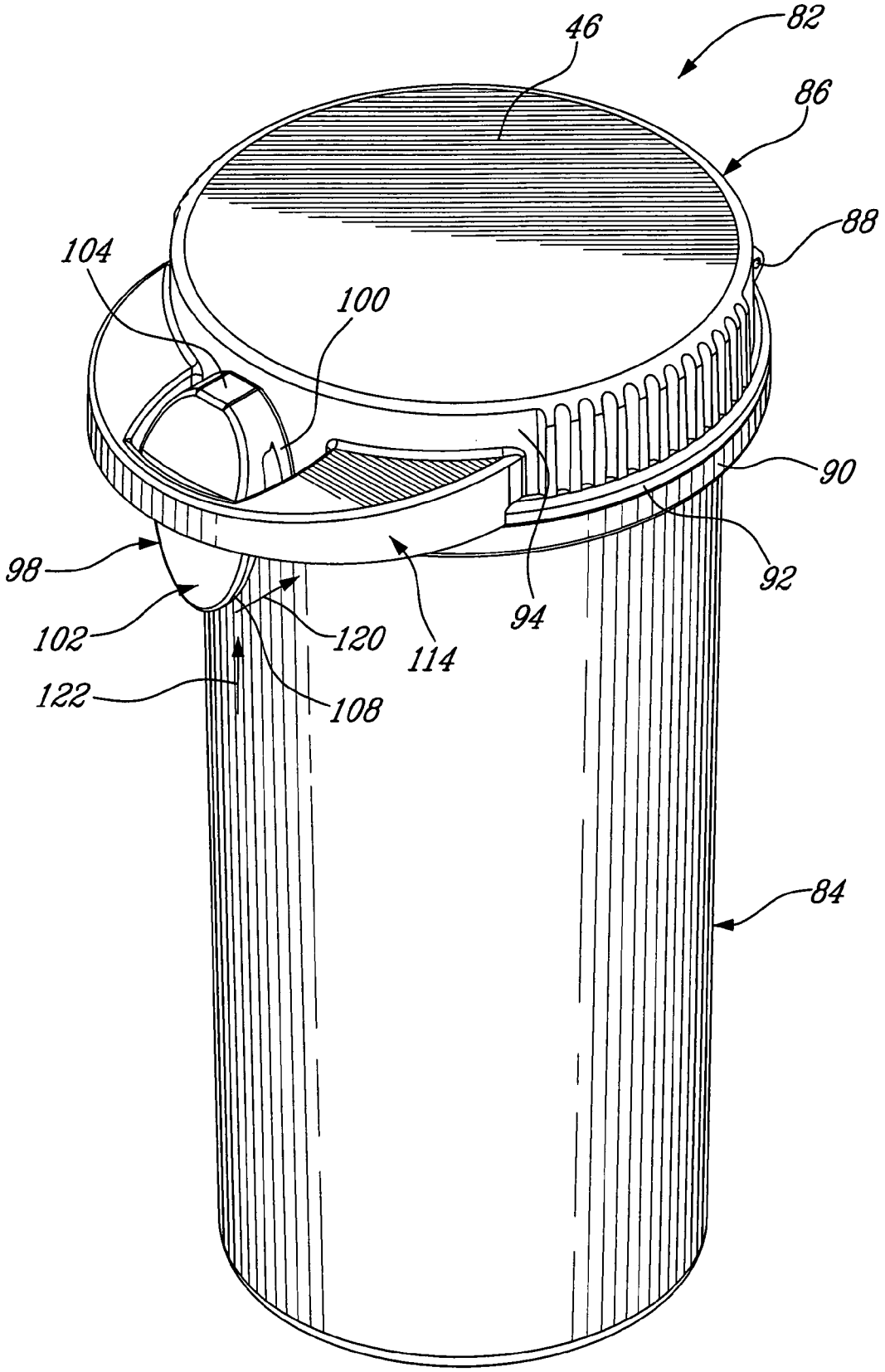
FIG. 10 is a top perspective view of a child-resistant vial according to a second illustrative embodiment of the present invention; the vial being illustrated closed and in a child-resistant configuration.
Figure 11:
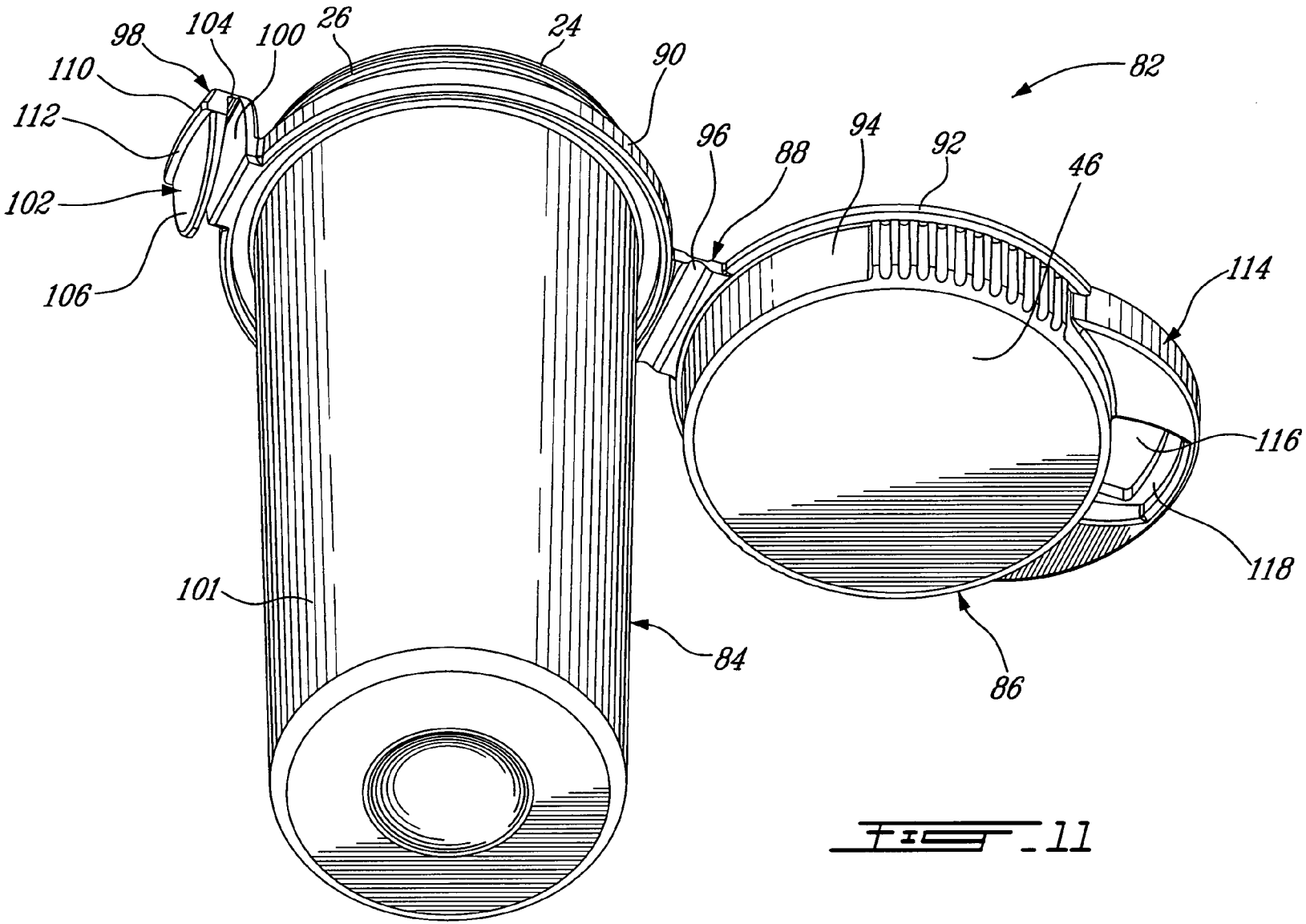
FIG. 11 is a top perspective view of the child-resistant vial from FIG. 10; the vial being illustrated opened.

With reference to FIGS. 10 and 11 of the appended drawings, a convertible child-resistant vial 82 according to a second illustrative embodiment of the present invention will be described. Since the vial 82 is similar to the vial 10, and for concision purposes, only the differences between the vials 82 and 10 will be described, the main differences pertaining to the first and second connection means.

The vial 82 comprises a container 84 and an integral cap 86, hingedly mounted to the container 84 via an integral hinge 88.

Similarly to the container 12, the container 84 includes a collar 90 located below the peripheral lip 26.

The integral hinge 88 extends from both the collar 90 and from a peripheral flange 92 of the cap 86, thereby further connecting the cap 86 to the container 84. The peripheral flange 92 extends from a skirt 94, which is similar to the skirt 48 of the vial 10.

The hinge 88 includes a throat portion 96 to increase the flexibility of the hinge 98.

A first connection element, in the form of a locking tooth 98, is integrally mounted to the collar 90 diametrically opposite the hinge 88. The locking tooth 98 is generally in the form of an inverted U-shaped member having a generally flat stem portion 100 extending from the collar 90 upwardly and a generally flat locking portion 102 connected to the stem portion 100 and distanced therefrom by a bridge portion 104. The bridge portion 104 provides a gap between the stem and locking portions 100 and 102 and allows the locking portion 102 to be movable between a neutral locking position (see on FIGS. 10 and 11) to an unlocking position which corresponds to the locking portion 102 (not shown) being moved towards the stem portion 100 beyond a threshold position. The bridge portion 104 causes the locking portion 102 to be biased to its locking position when no force is exerted thereon.

The locking portion 102 includes a tapered portion 106 having a rounded edge 108. The tapered portion 106 is connected to the bridge 104 through an abruptly thicker portion 110 which defines a shoulder 112 with the tapered portion 106.

The cap 86 includes a top portion 46 and a peripheral skirt 48 extending from the top portion 46.

The second connection element is in the form of a tab 114 extending from the skirt 94 opposite the hinge 88 and having a thickness. The tab 114 includes a notch 116 positioned diametrically opposite the hinge 88 so as to be registered with the locking tooth 98 when the vial 82 is closed by the cap 86. A shoulder 118 is provided in the notch 108 and defines a stop for the shoulder 112 of the locking tooth 98 when the tooth 98 is inserted in the notch 116. As will be appreciated by a person skilled in the art, both the tapered portion 106 and the rounded edge 108 of the tooth 98 allow easing the insertion of the tooth 98 in the notch 116 when the cap 86 is pivoted onto the container 84 during the closing of the vial 82.

In operation, when closed by the cap 86, the vial 82 can be opened by simultaneously pushing the tapered portion 106 of the tooth 98 towards the container 84 (see arrow 120 on FIG. 10) while lifting the cap 86, for example by pushing upwardly onto the tooth 98 so as to pivot the cap 86 (see arrow 122 on FIG. 10). In its child-proof configuration, the vial 82 requires two actions thereon for its opening.

To convert the vial 82 from a child-proof configuration (illustrated in FIGS. 10-11) to a non-child proof configuration (not shown), the locking portion 102 of the tooth 98 or the entire tooth 98 is removed.

Even though the vial 82 is illustrated with the tooth 98 being mounted to the container 84 and the notch 116 with the shoulder 118 being provided on the cap 86, it is believed to be within the reach of a person having ordinary skills in the art to use the present teaching to modify the vial 82 so that the tooth 98 is provided on the cap 86 and the notch 116 with the shoulder 118 is provided on the container 84, for example on a collar thereof (not shown).

Also, the vial 82 can be modified so that the unlocking of the cap 86 is achieved by another operation on the tooth 98 than its pushing onto the container 84. For example, the tooth can be modified to allow the unlocking of the cap by simultaneously lifting the cap and pulling onto the tooth in a direction away from the container.

It is to be noted that many modifications could be made to the vials 10 and 82 described hereinabove, for example:

The connection elements can be positioned at other location than diametrically opposite the hinge 16 or 96;

The hinge 16 or 96 can be configured to further bias the cap 14 or 86 towards or away the container 12 or 84;

The cap can be provided with any configuration of friction elements to ease the grip thereon; and The dimensions of the vial may vary depending, for example, on the application.

A vial according to the present can be used to contain medicine, toxic matter or any other substance that has to be kept out of reach of children. Of course, it can be used to contain non-toxic matter also.

It is to be understood that the invention is not limited in its application to the details of construction and parts illustrated in the accompanying drawings and described hereinabove. The invention is capable of other embodiments and of being practiced in various ways.

For example, the container can take other form than of a cylindrical body. The shape and configuration of the container and/or of its aperture can also be regular or irregular. In cases of embodiments requiring the cap to pivot on the container for opening the vial, an irregular shape container includes a cylindrical neck at its opening, which is configured to receive a round cap.

The first and second connection elements of a vial according to the present invention are not limited to notches and a tooth. For example, one of the connection elements can be in the form of a protrusion while the other is in the form of a complementary element for providing locking of the cap in a child-resistant way when the vial is closed.

Also, more than one pair of first and second connection elements can be provided for additional safety.

It is also to be understood that the phraseology or terminology used herein is for the purpose of description and not limitation. Hence, although the present invention has been described hereinabove by way of illustrative embodiments thereof, it can be modified, without departing from the spirit, scope and nature of the subject invention as defined in the appended claims.

What is claimed is:

1. A convertible child-resistant vial comprising:

a container having an aperture, a peripheral wall and a bottom and being provided with a first connection element in the form of a tooth; and a cap for closing the aperture, hingedly mounted to the container by a hinge integral to both the container and the cap; the cap including a second connection element in the form of a notch having a shoulder for engagement with the tooth for locking the vial;

the tooth including a stem portion secured to the container and a locking portion so secured to the stem portion via a bridge as to extend in a direction towards the bottom of the container and generally parallel to the container; the locking portion of the tooth including a shoulder portion for engaging the shoulder of the notch and locking the vial in a child-resistant manner; whereby, when the vial is locked, the tooth is prevented from being released from the notch unless the tooth is moved towards the container simultaneously to lifting the cap;

the bridge being breakable so as to allow removing the locking portion from the tooth to convert the child-resistant vial into a non-child-resistant vial.

2. A vial as recited in claim 1, wherein the container is in the form of a hollow cylindrical body having a circular peripheral wall defining a circular upper edge; the cap is configured to conform to the circular peripheral wall.

3. A vial as recited in claim 2, wherein the cap includes a peripheral skirt.

4. A vial as recited in claim 3, wherein the cap and the peripheral wall of the container respectively includes first and second cooperation elements to prevent an inadvertent opening of the vial when the vial is closed by the cap and the locking portion of the tooth is removed to convert the child-resistant vial into a non-child-resistant vial.

5. A vial as recited in claim 4, wherein the first cooperation element is a ring section on the peripheral skirt of the cap and the second cooperation element is a lip on the peripheral wall adjacent the edge thereof; the lip is positioned on the peripheral wall of the container so as to be registered with the ring section when the aperture of the container is closed by the cap, to put a pressure onto the lip during the closing of the aperture to secure the cap onto the container in a snap-fit manner.

6. A vial as recited in claim 2, wherein the cap includes at least one of a tab and a gripping element to help opening and closing the vial.

7. A vial as recited in claim 6, wherein the tab is positioned diametrically opposite the hinge.

8. A vial as recited in claim 1, resulting from a one-piece molding process.

9. A vial as recited in claim 1 which is made of a polymeric material.

10. A vial as recited in claim 9, wherein the polymeric material includes polypropylene.

11. A vial as recited in claim 1 made of a biodegradable material.

12. The use of the vial from claim 1 to contain a medicine or a toxic matter.

* * * * *